US006160214A

United States Patent [19]

Okamoto et al.

[11] Patent Number: 6,160,214

[45] Date of Patent: Dec. 12, 2000

[54] NON-CONSONANCE GENERATING DEVICE AND NON-CONSONANCE GENERATING METHOD

[75] Inventors: Seiji Okamoto; Toshiya Yoshida, both of Hamamatsu, Japan

[73] Assignee: Kawai Muscial Instruments Mfg. Co., Ltd., Shizuoka-ken, Japan

[21] Appl. No.: 09/474,805

[22] Filed: Dec. 29, 1999

[30] Foreign Application Priority Data

Dec. 29, 1998 [JP] Japan ..... 10-377415

[51] Int. Cl.[7] ..... G10H 1/06; G10H 7/00

[52] U.S. Cl. ..... 84/622; 84/623

[58] Field of Search ..... 84/608, 622, 623, 84/659

[56] References Cited

U.S. PATENT DOCUMENTS 5,641,929 6/1997 Okamoto et al. ..... 84/623

5,936,182 8/1999 Izumisawa ..... 84/623

*Primary Examiner*—Jeffrey Donels

[57] ABSTRACT

Harmonic signals of frequencies have a relation $fn=f1*n*\sqrt{1+C*n^2}/\sqrt{1+C}$ where C is a constant and n is a harmonic number relative to the fundamental frequency f1, are generated and synthesized to produce a modified sound that can be heard comfortably by human ears.

22 Claims, 11 Drawing Sheets

FIG. 4

60 (5)

| | | |
|---|---|---|
| CH0 | ON/OFF | FREQ. No. FN, KEY No. KN |
| | TONE No. TN, PART No. PN, TOUCH TC | |
| | RESONANCE DEGREES KD, TONE TIME TM ……. | |
| | HARMONIC No. n, LOUDNESS LN …… | |
| CH1 | ON/OFF | FREQ No. FN, KEY No. KN |
| | TONE No. TN, PART No. PN, TOUCH TC | |
| | RESONANCE DEGREES KD, TONE TIME TM | |
| | HARMONIC No. n, LOUDNESS LN …… | |
| CH2 | ON/OFF | FREQ. No. FN, KEY No. KN |
| | TONE No. TN, PART No. PN, TOUCH TC | |
| | RESONANCE DEGREES KD, TONE TIME TM | |
| | HARMONIC No. n, LOUDNESS LN …… | |
| | ⋮ | |
| CHn | ON/OFF | FREQ No. FN, KEY No. KN |
| | TONE No. TN, PART No. PN, TOUCH TC | |
| | RESONANCE DEGREES KD, TONE TIME TM | |
| | HARMONIC No. n, LOUDNESS LN …… | |
| CH0 | ENVELOPE SPEED ES / LEVEL EL | |
| | ENVELOPE SPEED ES / LEVEL EL | |
| | ⋮ | |
| | ENVELOPE PHASE EF | |
| CH1 | ENVELOPE SPEED ES / LEVEL EL | |
| | ENVELOPE SPEED ES / LEVEL EL | |
| | ⋮ | |
| | ENVELOPE PHASE EF | |
| | ⋮ | |
| CHn | ENVELOPE SPEED ES / LEVEL EL | |
| | ENVELOPE SPEED ES / LEVEL EL | |
| | ⋮ | |
| | ENVELOPE PHASE EF | |

FIG. 7

| INTER-VAL | KEY No. | C - VALUE | | |
|---|---|---|---|---|
| | | PIANO | HARPSICHORD | GUITAR |
| A0 | 1 | 1.1E-4 | | |
| A#0 | 2 | 1.1E-4 | | |
| B0 | 3 | 1.1E-4 | | |
| C1 | 4 | 9.0E-5 | | |
| C#1 | 5 | 9.0E-5 | | |
| D1 | 6 | 8.0E-5 | | |
| D#1 | 7 | 8.0E-5 | | |
| E1 | 8 | 7.0E-5 | | |
| F1 | 9 | 6.0E-5 | | |
| F#1 | 10 | 6.0E-5 | | |
| G1 | 11 | 5.6E-5 | | |
| G#1 | 12 | 5.6E-5 | | |
| A1 | 13 | 5.3E-5 | | |
| A#1 | 14 | 4.4E-5 | | |
| B1 | 15 | 4.4E-5 | | |
| C2 | 16 | 4.5E-5 | 1.1E-5 | |
| C#2 | 17 | 5.0E-5 | 1.1E-5 | |
| D2 | 18 | 5.0E-5 | 1.1E-5 | |
| D#2 | 19 | 5.5E-5 | 1.1E-5 | |
| E2 | 20 | 6.0E-5 | 1.1E-5 | |
| F2 | 21 | 6.0E-5 | 1.1E-5 | 4.0E-5 |
| F#2 | 22 | 7.0E-5 | 1.1E-5 | 4.0E-5 |
| G2 | 23 | 7.0E-5 | 1.1E-5 | 4.0E-5 |
| G#2 | 24 | 8.0E-5 | 1.1E-5 | 4.0E-5 |
| A2 | 25 | 8.0E-5 | 1.1E-5 | 4.0E-5 |
| A#2 | 26 | 9.0E-5 | 1.1E-5 | 4.0E-5 |
| B2 | 27 | 1.0E-4 | 1.1E-5 | 4.0E-5 |
| C3 | 28 | 1.1E-4 | 1.2E-5 | 4.0E-5 |
| C4 | 40 | 3.0E-4 | 2.0E-5 | 4.0E-5 |
| A#4 | 50 | 8.0E-4 | 4.0E-5 | 3.8E-5 |
| C6 | 64 | 3.0E-3 | 1.3E-4 | 3.4E-5 |
| F#6 | 70 | 6.0E-3 | 2.2E-4 | 3.0E-5 |
| E7 | 80 | 1.8E-2 | | |
| C8 | 88 | 5.0E-2 | | |

FIG. 9

| HARMONIC No. | NON-CONS. CONSTANT C 1.00E-03 | NON-CONS. CONSTANT C 1.00E-04 | NON-CONS. CONSTANT C 1.00E-05 | DEVIATION DATA $(A/6)\times n^3$ |
|---|---|---|---|---|
| 1ST HARMONIC | 1.000000000 | 1.000000000 | 1.000000000 | — |
| 2ND HARMONIC | 2.002994761 | 2.000299948 | 2.000029999 | — |
| 3RD HARMONIC | 3.011964155 | 3.001199640 | 3.000119996 | 0.000134996 |
| 4TH HARMONIC | 4.029858588 | 4.002998576 | 4.000299986 | 0.000319989 |
| 5TH HARMONIC | 5.059585022 | 5.005995805 | 5.000599958 | 0.000624979 |
| 6TH HARMONIC | 6.103993878 | 6.010489780 | 6.001049898 | 0.001079964 |
| 7TH HARMONIC | 7.165867034 | 7.016778212 | 7.001679782 | 0.001714942 |
| 8TH HARMONIC | 8.247907130 | 8.025157923 | 8.002519578 | 0.002559915 |
| 9TH HARMONIC | 9.352728290 | 9.035924701 | 9.003599244 | 0.003644879 |
| 10TH HARMONIC | 10.482848367 | 10.049373165 | 10.004948726 | 0.004999833 |
| 11TH HARMONIC | 11.640682734 | 11.065796619 | 11.006597955 | 0.006654778 |
| 12TH HARMONIC | 12.828539612 | 12.085486920 | 12.008576849 | 0.008639712 |
| 13TH HARMONIC | 14.048616884 | 13.108734344 | 13.010915308 | 0.010984633 |
| 14TH HARMONIC | 15.303000300 | 14.135827455 | 14.013643216 | 0.013719542 |
| 15TH HARMONIC | 16.593662958 | 15.167052978 | 15.016790435 | 0.016874437 |
| 16TH HARMONIC | 17.922465936 | 16.202695679 | 16.020386808 | 0.020479317 |
| ⋮ | ⋮ | ⋮ | ⋮ | ⋮ |
| 32ND HARMONIC | 45.502807545 | 33.596796358 | 32.163261888 | 0.163834539 |
| ⋮ | ⋮ | ⋮ | ⋮ | ⋮ |
| 64TH HARMONIC | 144.403475153 | 75.981210082 | 65.297239779 | 1.310676309 |
| ⋮ | ⋮ | ⋮ | ⋮ | ⋮ |
| 128TH HARMONIC | 533.418148434 | 207.901955926 | 138.087522530 | 10.485410470 |
| ⋮ | ⋮ | ⋮ | ⋮ | ⋮ |

NON-CONSONANCE GENERATING DEVICE AND NON-CONSONANCE GENERATING METHOD

BACKGROUND OF THE INVENTION

1. Field of the Invention

The present invention relates to a non-consonance generating device and to a non-consonance generating method. More particularly, the invention relates to a device for synthesizing non-consonance onto a tone that is generated and to a method thereof.

2. Related Art

So far, harmonics of a tone have been synthesized by generating sine signals of harmonics of frequencies which are 2 times, 4 times, 8 times, 16 times, as high as a fundamental frequency, in addition to generating sine signals of the fundamental frequency, and by synthesizing the fundamental harmonic and the harmonics. When the levels of harmonics change and the ratio of synthesizing the harmonics changes, then, the waveform of the synthesized sound and timbre change.

However, the following experimental results were obtained after allowing a person hear such synthesized sound of harmonics. Synthesized sound in which the frequency ratios of harmonics are not correct ratios of integers is heard comfortably, as compared to synthesized sound in which the frequency ratios of harmonics are correctly 2 times, 4 times, 8 times, 16 times, that of the fundamental frequency. Accordingly, it has been found that a rule exists in the frequencies of harmonics of sound which is comfortably heard. A feature of the present invention is to set frequencies of harmonics of synthesized sound so that they can be heard comfortably by human ears.

SUMMARY OF THE INVENTION

Harmonic signals of frequencies having a relationship $fn=f1\times n\times root\ (1+C\times n^2)/root\ (1+C)$ (C is a constant, n is a harmonic number, root is a square root of values in the succeeding parenthesis) relative to the fundamental frequency f1, are generated, and a signal of the fundamental frequency f1 and harmonic signals are synthesized.

When the frequency of a second harmonic of the fundamental frequency is shifted by a value A (a frequency two times as high as that of the fundamental frequency), the frequency of an n-th harmonic is successively shifted by a frequency which is n times as high as the fundamental frequency. This shift is varied nearly in proportion to $(A\times n^3)$ and harmonic signals of these frequencies are generated to synthesize the signal of the fundamental frequency f1 and harmonic signals.

When the frequency of the second harmonic relative to the fundamental frequency is shifted by a value A relative to the frequency two times as high as the fundamental frequency, the frequency of the n-th harmonic is successively shifted relative to the frequency which is n times as high as the fundamental frequency. The shift is nearly $(A/6)\times(n^3-n)$, and harmonic signals of these frequencies are generated to synthesize the signal of the fundamental frequency f1 and harmonic signals.

Further, when the frequency of the second harmonic of the fundamental frequency is shifted by a value A, (frequency two times as high as the fundamental frequency, the frequency of the n-th harmonic is successively deviated the frequency which n times as high as the fundamental frequency. The shift is nearly $(A/6)\times(n^3-n^2+n-1)$, and harmonic signals of these frequencies are generated to synthesize the signal of the fundamental frequency f1 and harmonic signals.

Thus, a synthesized harmonic sound is generated which can be heard comfortably by human ears. The harmonic of a harmonic number n=1 is the fundamental harmonic which is excluded from the harmonics in a narrow sense, and the first harmonic becomes the second harmonic sound of a harmonic number n=2.

Advantages of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus do not limit the present invention.

FIG. 4 is a diagram illustrating an assignment memory 60 in the tone signal generator 5;

FIG. 7 is a sheet showing non-consonance constants C stored in a non-consonance constant table 85 in the frequency number accumulator 42;

FIG. 9 is a sheet concretely showing non-consonant frequency ratios;

DETAILED DESCRIPTION

Figure 5:
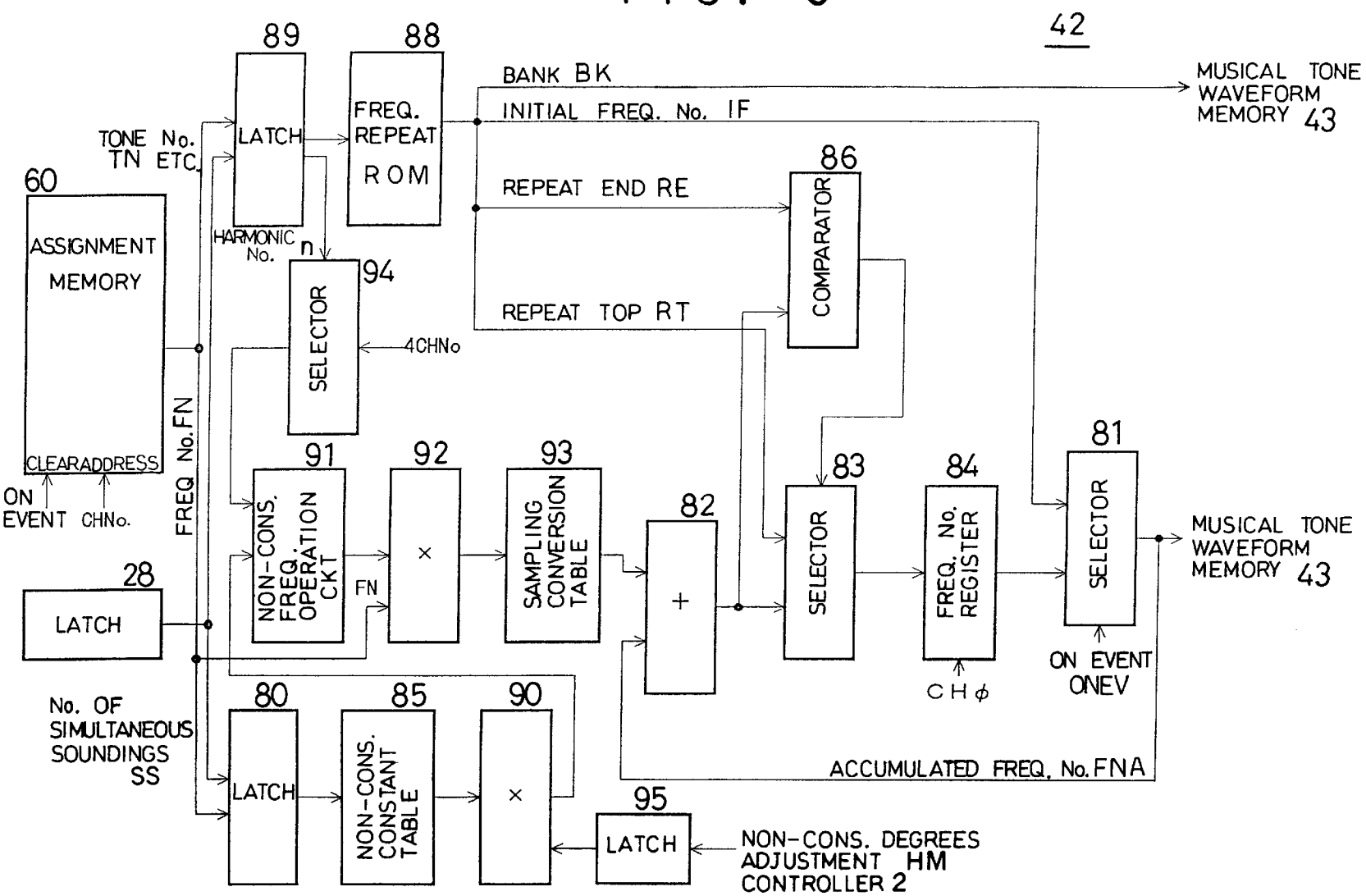
FIG. 5 is a diagram illustrating a frequency number accumulator 42 (first embodiment) in the tone signal generator 5.
Figure 6:
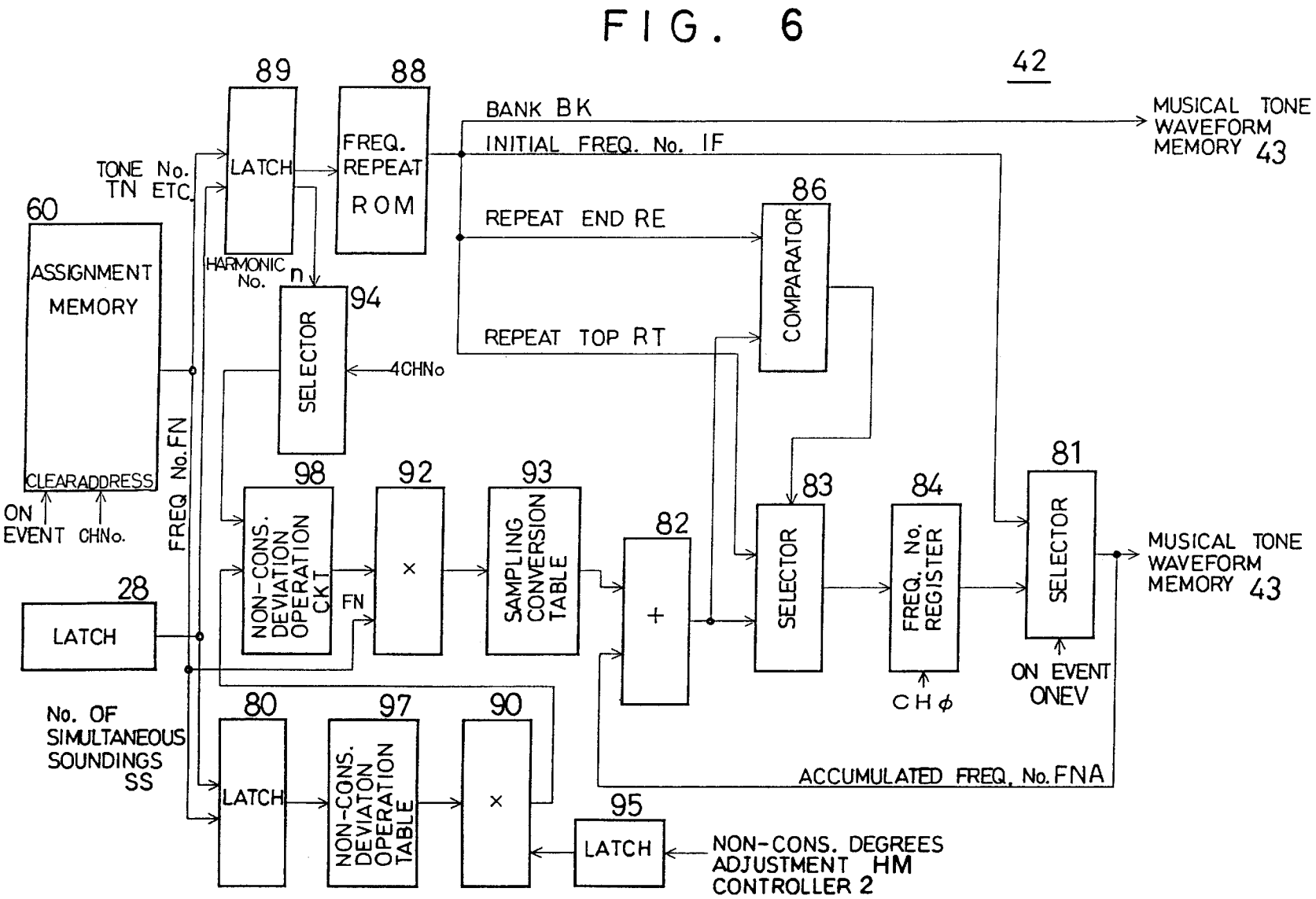
FIG. 6 is a diagram illustrating a frequency number accumulator 42 (second embodiment) in the tone signal generator 5.

Referring to FIGS. 5 and 6, in an embodiment the frequency number data FN and tone number data TN are read out in a time-dividing manner from the assignment memory 60, are converted into non-consonance constants C in a non-consonance constant table 85, and are processed with the harmonic number data n in a non-consonant frequency operation circuit 91. The harmonic number data n, which has four part sounds (harmonics) are further sent in a time-dividing manner to the non-consonant frequency operation circuit 91. This operation is $fn=f1\times n\times root\ (1+C\times n^2)/root\ (1+C)$, whereby the frequency of the four part sounds (harmonics) is found, and is accumulated by an adder 82 in a time-dividing manner. Musical waveform data MW of the part sounds are then read out in the time-dividing manner from a musical waveform memory 43, and are accumulated and synthesized in an accumulator 46.

1. Circuitry

Figure 1:
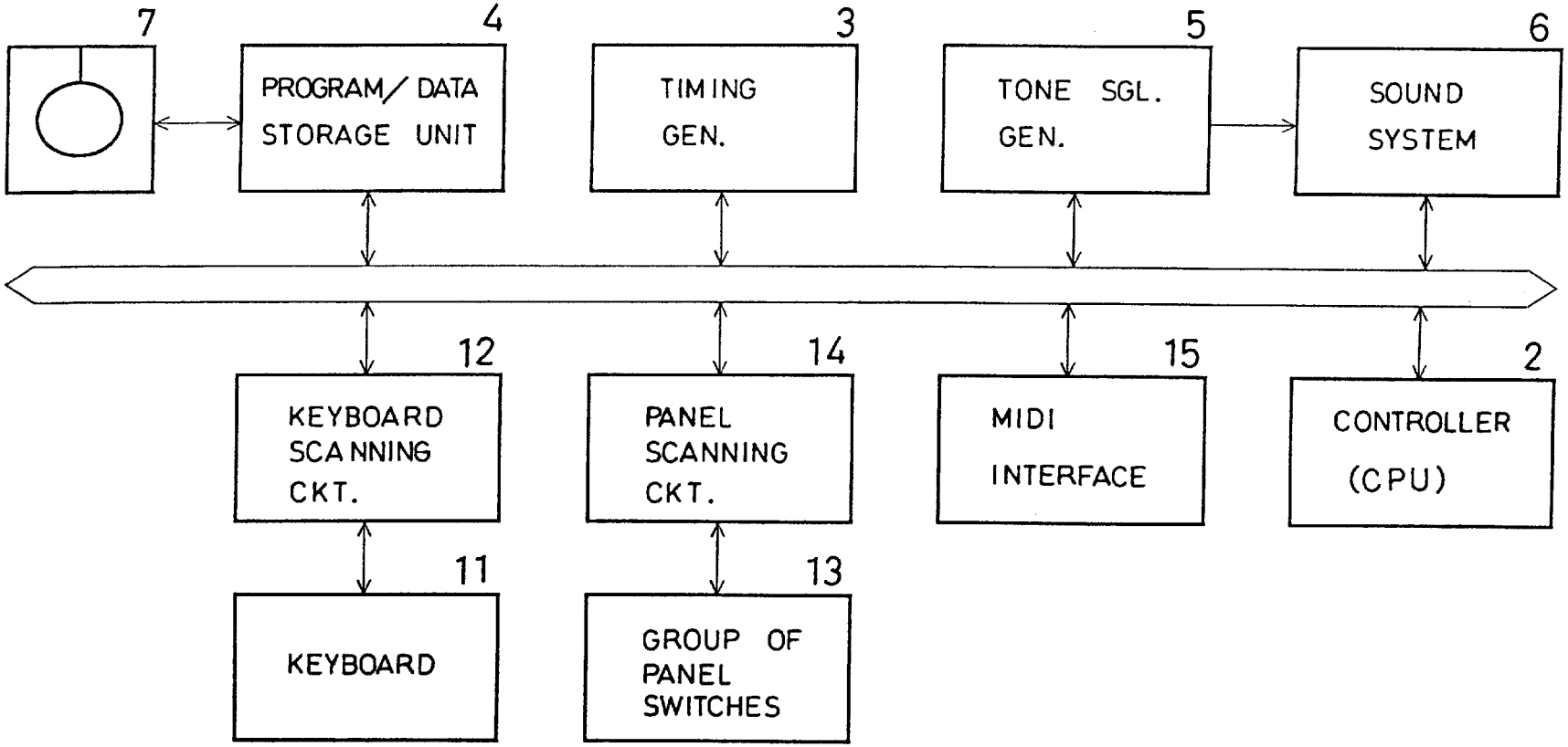
FIG. 1 is a diagram illustrating the circuitry of a non-consonance generating device and/or an electronic musical instrument.

FIG. 1 is a diagram illustrating the circuitry of an electronic sound apparatus and/or electronic musical instrument. The sounding start and sounding end of a tone are applied by the keys of a keyboard 11. The keys are scanned by a key scanning circuit 12, whereby data that represents key on or key off is detected and is written by a controller 2 into a program/data storage unit 4. The data is compared with the data representing the on or off of the keys that have been stored in the program/data storage unit 4, and the on event or off event of the keys is determined by the controller 2.

Every key of the keyboard 11 is provided with a step touch switch, the scanning is effected for every step switch, and on event/off event is detected for every head on/off of every step switch. The step switch generates the touch data, i.e., an initial touch data and an after-touch data that represent the speed and strength of touch.

The keyboard 11 comprises a lower keyboard, an upper keyboard and a pedal keyboard to generate tones of different timbres, i.e., to generate tones having different envelope waveforms. Tones of two timbres can be sounded simultaneously by a key-on of the upper keyboard. Alternatively the keyboard 11 may be replaced by that of an electronic string instrument, electronic wind (reed) instrument, electronic percussion (pad) or computer, for example.

The switches in a group of panel switches 13 are scanned by a panel scanning circuit 14. Due to the scanning, the data representing on and off of the switches are detected and are written by the controller 2 into a program/data storage unit 4. The data are compared with the data representing on and off of the switches that have been stored in the program/data storage unit 4, and on event and off event of the switches are determined by the controller 2. The sounded tone is that of manual play using the keyboard 11 or that of auto play (automatic performance) reproduced from the automatic play data. The tones of manual play or automatic play are also sent from a MIDI interface 15.

The MIDI interface 15 is for transmitting and receiving tone data to and from an electronic musical instrument that is externally connected. The tone data comply with the MIDI (musical instrument digital interface) standards, and the tone is also generated based on these tone data.

The keyboard 11 or the MIDI interface 15 also includes an automatic play device. The play data (tone-generating data) generated by the keyboard 11, group of panel switches 13 and MIDI interface 15, are for generating the tones. The manual play data of the keyboard 11 are written and stored in the program/data storage unit 4 as automatic play data. Through the MIDI interface 15, the automatic play data are sent from other equipment, or the automatic play data in the program/data storage unit 4 are sent to other equipment.

The performance information (data) (tone-generating information (data)) are musical factor data inclusive of tone pitch (tone pitch range) data (tone-determining factor), sounding time data, field-of-performance information, number-of-sounds data and resonance degree data. The sounding time data represent the passage of time from the start of sounding a tone. The field-of-performance information represent part of play, part of tone, part of musical instrument, etc., and are corresponded to, for example, melody, accompaniment, background, chord, bass and rhythm, or are corresponded to an upper keyboard, a lower keyboard or a foot keyboard.

The pitch data are accessed as key number data KN. The key number data KN include octave data (tone pitch range data) and tone name data. The field-of-performance information are accessed as part number data PN. The part number data PN distinguish the areas of play and are set depending upon the area of play of a tone that is sounded.

The sounding time data are accessed as tone time data TM, and are based upon time count data from a key-on event or substituted by envelope phase. The sounding time data have been closely disclosed in the specification and drawings of Japanese Patent Application No. 219324/1994 as data related to the passage of time from the start of sounding.

The number-of-sounds data represent the number of tones that are concurrently sounded. For example, on/off data of an assignment memory 30 are based on the number of tone "1", which is found from flow charts of FIGS. 9 and 15 of Japanese Patent Application No. 242878/1994, FIGS. 8 and 18 of Japanese Patent application No. 276855/1994, FIGS. 9 and 20 of Japanese Patent Application No. 276857/1994, and FIGS. 9 and 21 of Japanese Patent Application No. 276858/1994.

The resonance degree data (KD) represents the degree of resonance between a tone and another tone that are simultaneously generated. The resonance degree has a large value when a ratio of integers is small between a pitch frequency of the tone and a pitch frequency of another tone, and the resonance degree has a small value when a ratio of integers is great, as can be found by the processing of a flow chart that will be described later. The resonance degree data includes a consonance degree of pitch and frequency of the tones simultaneously generated, consonance relation thereof, resonance relation of the tones simultaneously generated and resonance contents thereof.

The panel switches 13 are equipped with various switches inclusive of timbre tablet, effect switch, rhythm switch, pedal, wheel, lever, dial, handle and touch switch, which are for musical instruments. The pedal is loud pedal, soft pedal, damper pedal, shifting pedal, sostenuto pedal or mute pedal.

Tone control data are generated by these switches. The tone control data are musical factor data for controlling the tone that is generated, and include timbre data (timbre-determining factor), touch data (speed/strength of sounding instruction operation), number-of-sounds data, degree-of-resonance data, effect data, rhythm data, sound image (stereo) data, quantize data, modulation data, tempo data, sound volume data and envelope data.

These musical factor data, too, are synthesized with the performance information (tone data) and are input through a variety of switches, and are further synthesized with the automatic performance information, or are synthesized with the performance information transmitted and received through the interface. A touch switch is provided for each of the sound instruction devices, and generates initial touch data that represents the quickness and strength of touch as well as after touch data.

The timbre data are associated with to the kinds of musical instruments (sounding media/sounding means) such as a keyboard instrument (piano, etc.), a wind instrument (flute, etc.), a stringed instrument (violin, etc.) and a percussion instruments (drum, etc.), and are accessed as tone number data. The envelope data include an envelope time, an envelope level, an envelope speed and an envelope phase.

The loudness (volume) data is taken in as loudness data LN to represent the magnitude of the tone. The loudness data LN is determined based on the touch data TC, volume data, etc. Depending upon the cases, the loudness data LN is determined depending also upon the number of soundings, resonance degree data, etc.

Such musical factor data are sent to a controller 2 where a variety of signals, data and parameters which will be described later, data and parameters are changed over to determine the content of the tone. The performance information (tone-generating data) and tone control data are processed by the controller 2, a variety of data are sent to an acoustic output unit 5, and a tone signal is generated. The controller 2 includes CPU, ROM and RAM.

A program/data storage unit 3 (internal storage medium/means) comprises a storage unit such as a ROM, a writable RAM, a flush memory or an EPROM, and in which can be written and stored (installed/transferred) a program of a computer stored in a data storage unit 4 (external storage medium/means) such as an optical disk or a magnetic disk. In the program/data storage unit 3 are further stored (installed/transferred) programs transmitted from an external electronic musical instrument or a computer through the MIDI device or the transmitter/receiver. The program storage medium includes a communication medium.

The installation (transfer/copy) is automatically executed when the data storage unit 3 is set into the tone-generating apparatus or when the power source of the tone-generating apparatus is turned on, or is installed by the operation of an operator. The above-mentioned program corresponds to a flow chart that will be described later, with which the controller 2 executes a variety of processings.

The apparatus may store, in advance, another operating system, system program (OS) and other programs, and the above-mentioned program may be executed together with these OS and other programs. When installed in the apparatus (computer body) and executed, the above-mentioned program executes the processings and functions described herein by itself, or together with other programs.

Moreover, part or all of the program may be stored in, and executed by, one or more apparatuses other than the above-mentioned apparatus. The data to be processed, and the data/program that has been already processed may be exchanged among the above-mentioned apparatus and other apparatuses through communication means i.e., (Internet).

In the program/data storage unit 3 are stored the above-mentioned musical factor data, the above-mentioned variety of data and various other data. These variety of data include data necessary for the time-division processing as well as data to be assigned to the time-division channels.

The tone generator 5 repetitively generates a tone waveform signal MW for every part sound, and a sound system 6 generates sound and outputs. The rate for repetitively generating the tone waveform signals MW varies depending upon the tone pitch data. Further, the waveform of the repetitively generated tone waveform signals MW is changed over depending upon the musical factor data such as the timbre data mentioned above. Relying upon the time-division processing, the tone generator 5 simultaneously forms a plurality of tone signals to generate a polyphonic sound.

The timing-generating unit 6 outputs timing control signals to every circuit so that the whole circuitry of the reverberating/resonating apparatus, tone-generating/controlling apparatus or an electronic musical instrument is maintained in synchronism. The timing control signals include clock signals of all periods, as well as a signal of a logical product or a logical sum of these clock signals, a signal of a period of a channel-dividing time of the time-division processing, channel number data CHNo and time count data TI. The time count data TI represents the absolute time, i.e., the passage of the time. The period from a reset due to the overflow of the time count data TI until a reset due to the next overflow is set to be longer than the longest sounding time among various tones and is set, depending upon the cases, to be several times as great.

2. Tone Signal Generator 5

Figure 2:
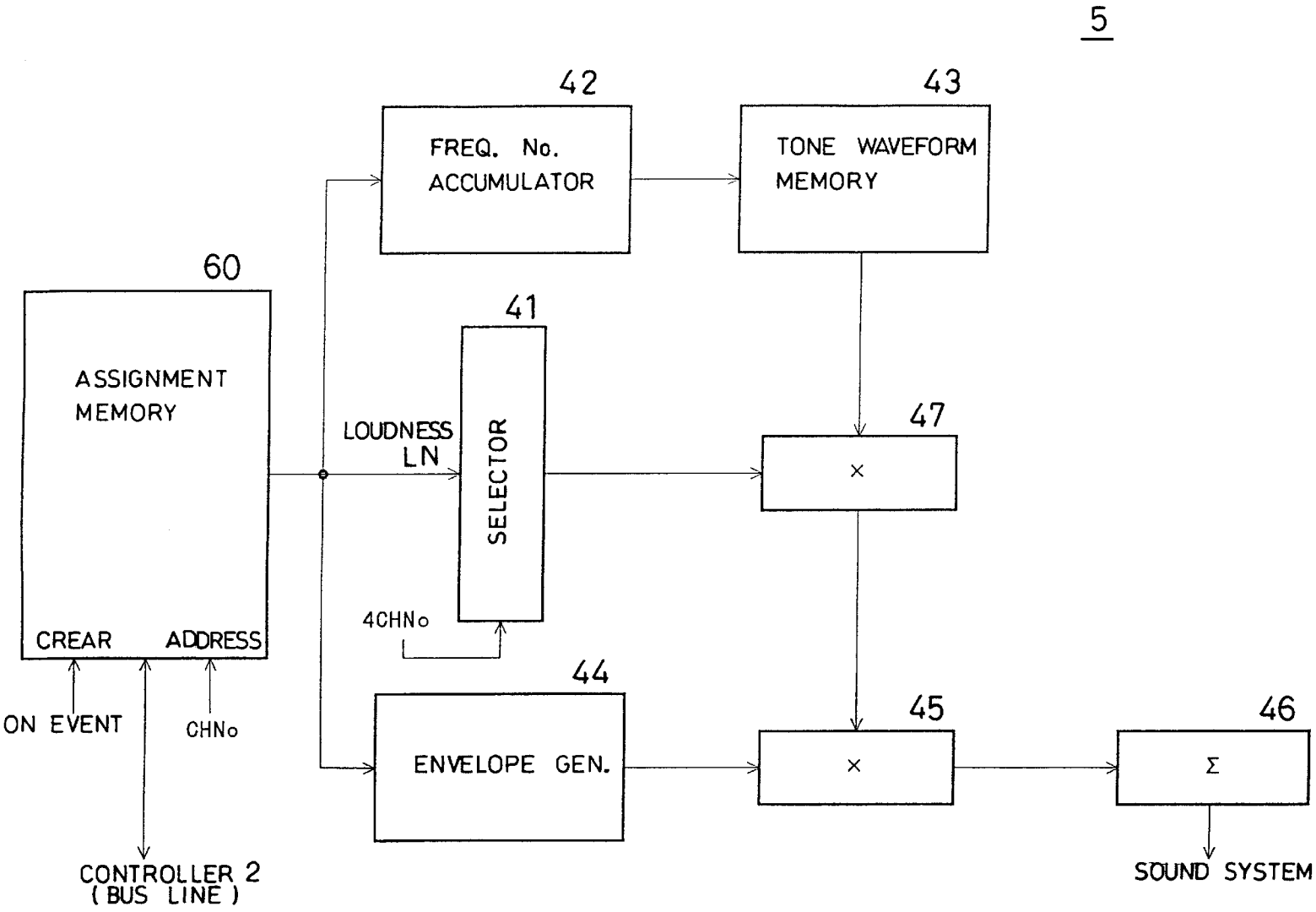
FIG. 2 is a diagram illustrating a tone signal generator 5.

FIG. 2 illustrates the tone generator 5. Musical factors such as key number data KN and tone number data TN of the channels read out from the assignment memory 60, are sent to a frequency number accumulator 42 which accumulates the frequency number data FN corresponding to the key number data KN in a time-dividing manner. The accumulated frequency number data FNA are fed to a musical tone waveform memory 43 as read-out address data in a time-dividing manner. The frequency number accumulator 42 calculates and synthesizes (adds) the synthesized fluctuation data SSW to the frequency number data FN in a time-dividing manner.

The musical tone waveform memory 43 stores a plurality of musical tone waveform data MW which are read out based on the accumulated frequency number data FNA in a time-dividing manner. The musical tone waveform data MW are selected based on the musical factors such as the tone number data TN, or based on the selection operation by the operator using the group of panel switches 13.

The musical factor such as tone number data TN are read out from the assignment memory 60, sent to the frequency number accumulator 42, converted into bank data BK, and are fed as high-order read-out address data to the musical tone waveform memory 43. The low-order read-out address data are the above-mentioned accumulated frequency number data FNA.

The musical tone waveform data MW are sampling data having a waveform of an instrument sound such as of piano, violin, flute, cymbals, etc. The musical tone waveform data MW may vary depending upon the waveforms such as sine wave, saw-tooth wave or rectangular wave, depending upon the content ratios of specific components such as harmonic components or noise components, depending upon the groups of spectral components based on specific formants, depending upon the kinds of whole waveforms from the sounding start to the sounding end, or depending upon the touch data TC and/or key scaling data KS.

The four loudness data LN of the part sounds read out in parallel from the assignment memory 60 are arranged in series through a selector 41, sent to a multiplier 47, and are multiplied on the musical waveform data MW of the part sounds. This determines the magnitudes of the part sounds, i.e., determines the ratio of synthesizing the part sounds. To the selector 41 are fed, as a selection signal, the lower two bits of the channel number data 4CHNo having an increment speed four times as great. When the levels of the four part sounds are changed, i.e., when the loudness data LN are changed to alter the ratio of synthesis, the shape of the musical waveform of the synthesized sound changes and, hence, the timbre changes.

The musical tone waveform data MW of simple shapes such as of sine waves, saw-tooth waves and rectangular waves can also be generated by a high-speed operation processing. Even complex waveforms can be generated by the high-speed operation processing as a matter of course.

Musical factors such as the tone number data TN of the channels read out from the assignment memory 60 are sent to an envelope generator 44 which generates the envelope waveform data EN depending upon the tone number data TN, etc. in a time-dividing manner. The envelope waveform data EN are multiplied by the musical tone waveform data MW read out from the musical tone waveform memory 43 through a multiplier 45, and are accumulated over the whole channels through an accumulator 46 and are sent to the sound system 6 to be sounded and output (that produces sound). The accumulator 46 is divided into two. The preceding accumulator 46 may accumulate the four part sounds each time, and the succeeding accumulator 46 may accumulate the whole tones.

3. Part Sound Table 10

Figure 3:
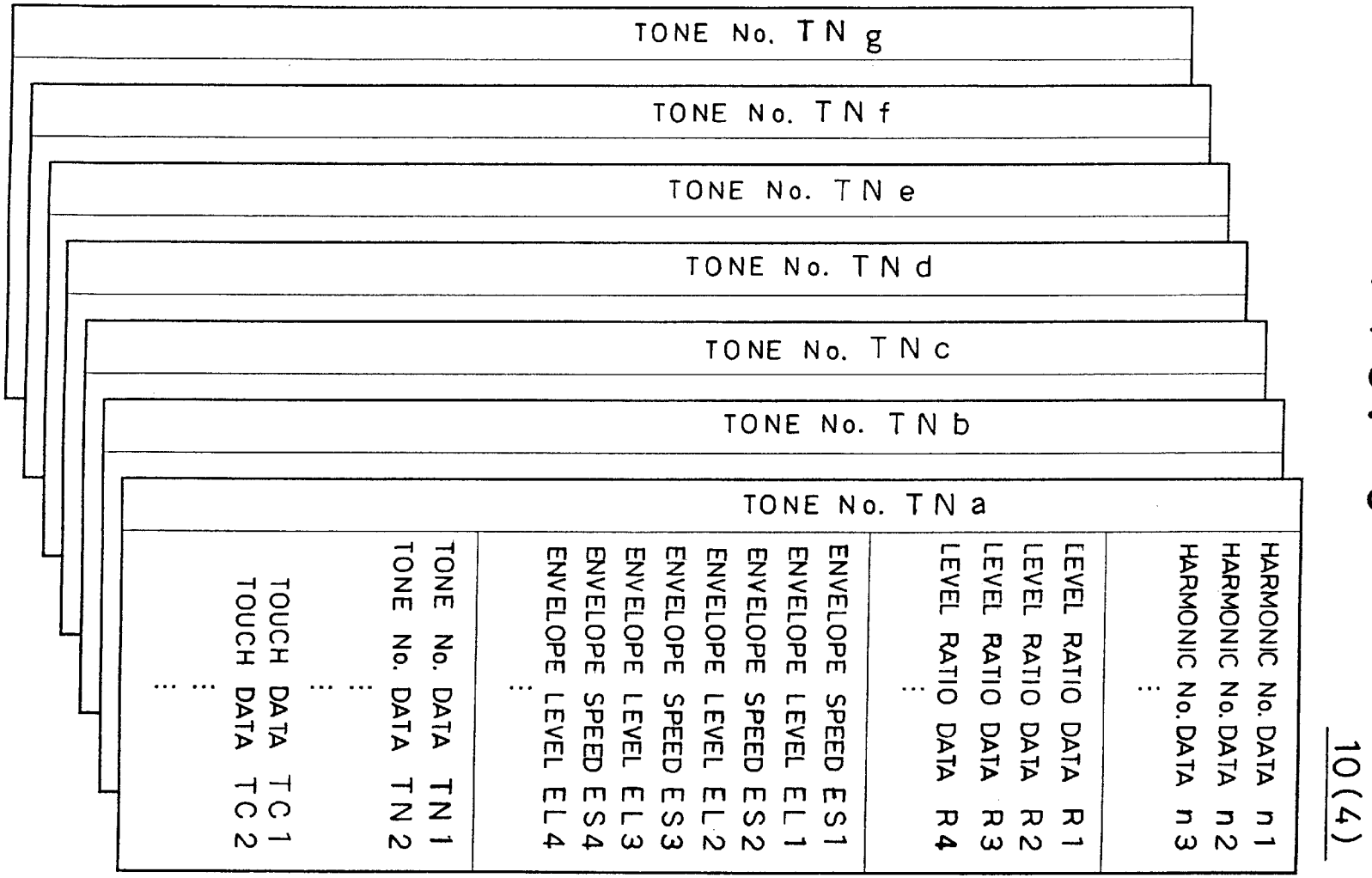
FIG. 3 is a part sound table 10 in a program/data storage unit 4.

FIG. 3 illustrates a part sound table 10 in the program/data storage unit 4. The part sound table 10 stores musical factors of the part sounds. The tone number data TN of the tone is converted by the part sound table 10 into a harmonic number data n of the part sounds. The frequencies of the part sounds, i.e., of the harmonics are found based on the harmonic number data n of the part sounds.

Each part sound comprises the fundamental harmonic and harmonics, and a tone is generated by synthesizing the harmonics. The harmonic number data n are usually integers such as 2, 3, 4, 5, 6, etc., and represent degrees of harmonics or harmonic numbers. The harmonic of a harmonic number data n=1 is the fundamental harmonic which is excluded from the harmonics in a narrow sense. The first harmonic has a harmonic number n=2. The harmonic number data n are usually 2, 4, 8. Depending upon the cases, however, the harmonic number data n may often jump over (like 2, 8, 32), may assume odd numbers like 3, 5, 9, or may (in rare cases) be non-integers like 1.5, 3.3, 7.1, 16.8. The harmonic number data HN of the fundamental harmonic is "1" at all times and is omitted.

The tone number data TN of the tones are converted by the part sound table 10 into level ratio data LR of the part sounds. The level ratio data LR of the part sounds are multiplied on the loudness data LN of the whole synthesized sound to thereby find loudness data LN of the part sounds. The loudness data LN of the part sounds are written into the channel areas of the assignment memory 60. The magnitudes or levels of the part sounds are determined by the loudness data LN of the part sounds. The loudness data LN of the whole synthesized sound are determined based on the touch data TC, volume data, etc. The level ratio data LR are stored, even ratio data concerning the fundamental harmonic.

The tone number data TN of the tones are converted by the part sound table 10 into envelope data of the part sounds. The envelope waveforms of the part sounds are determined by the envelope data of the part sounds. The envelope data of the part sounds are written into the channel areas of the assignment memory 60. As described earlier, the envelope data comprise envelope speed data ES and envelope level data EL of the envelope phases.

The envelope data of the part sounds may be omitted and, instead, an envelope data may be set for the entire synthesized sound. Further, the tone number data TN, harmonic number data n and envelope data of the part sounds may be converted not from the tone number data TN of the tone, but from other musical factors of the tone. Musical factors of the part sounds can also be selected or changed over by the operation of an operator using a group of panel switches 13.

Although other musical factors of the part sounds are not different for each of the part sounds, they may be different for each of the part sounds. For example, the touch data TC may be different for each of the part sounds. Accordingly, the touch characteristics differ depending upon the part sounds. The resonance degree data KD may be different for each of the part sounds. Hence, the resonance characteristics differ for each of the part sounds.

The tone number data TN of the whole synthesized sound may be converted by the part sound table 10 into tone number data TN that are different depending upon the part sounds. Therefore, the musical waveform data MW of the part sounds have different shapes, and the harmonics having different musical waveforms are synthesized. The tone number data TN of the part sounds are written into the channel areas of the assignment memory 60.

4. Assignment Memory 60

FIG. 3 is a diagram illustrating an assignment memory 60 in the tone generator 5. The assignment memory 60 includes a plurality (16, 32, 64, etc.) of channel memory areas for storing data related to the part sounds assigned to a plurality of tone-forming channels formed in the tone generator 5.

The channel memory areas store frequency number data FN, key number data KN and envelope data of part sounds to which the channels are assigned. Tone number data TN, touch data TC, tone time data TM, part number data PN, resonance degree data KD, on/off data and fluctuation level data SL are stored, too.

The on/off data indicates whether the tone (part sound) that is assigned to be sounded, is being keyed on or sounded on (1), or being keyed off or sounded off (0). The frequency number data FN represents the frequency of the part sound that is assigned and sounded on, and is converted from the key number data KN that is multiplied by the key number radio data KR. The program/data storage unit 4 is provided with a table (decoder) for the conversion.

The envelope data comprises an envelope speed data ES and an envelope level data EL for each of the envelope phases. The envelope speed data ES represents a step value of operation per a period of digital operation of the envelope. The envelope level data EL represents a target value to be reached by the operation of the envelope for each of the phases. A counted value from a phase counter 50 that will be described later is stored as an envelope phase data EF in the assignment memory 60. The envelope data are read out from the program/data storage unit 4 based on the musical factors such as tone number data TN or based on the selection operation by an operator using the group of panel switches 13.

The key number data KN represents the pitch (frequency) of a tone that is assigned and sounded on, and is determined by the pitch data. The key number data KN is stored for all part sounds that constitute a tone. The key number data KN is additionally stored in the corresponding channel memory area of the assignment memory 60 every time when there is an on event, and the part sounds are assigned to the channels and are synthesized. The corresponding key number data KN is erased every time when there is an off event. The high-order data in the key number data KN represents a tone pitch range or octave, and the low-order data represents the tone name. The key number data KN may be omitted.

The tone number data TN represents the timbre of tone that is assigned and sounded on, and is determined depending on the timbre data. When the tone number data TN differs, the timbre differs and the tone waveform of the tone differs, too. The touch data TC represents the speed or strength of the sounding operation, and is determined depending on the touch data. The part number data PN represents the play area as described above, and is set depending on which play area the tone that is sounded is from. The tone time data TM represents the passage of time from the key on event.

The four loudness data LN represent the magnitudes of the part sounds. The ratio of synthesizing the harmonics is determined by the magnitudes of the four loudness data LN, and the timbre of the synthesized tone is determined. The loudness data LN of the part sounds are found by multiplying the loudness data LN of the whole synthesized tone by the level ratio data LR of the part sounds from the part sound table 10, and are stored.

The harmonic number data n represent the degrees of harmonics of the part sounds that are to be synthesized. The assignment memory 60 stores not only the harmonic number data n of three harmonics but also the harmonic number data n "1" of the fundamental harmonic.

The tone number data TN are set as the whole synthesized tone. Therefore, the four part sounds constituting the synthesized tone usually, have the same tone number data TN, and thus the same musical waveform data MW are read out. As described above, however, the four part sounds may have different tone number data TN. In this case, musical waveform data MW of different waveforms are read out as the part sounds.

Since the musical waveform data MW that are read out are sine waves, the four part sounds are also in the form of four sine waves of different frequencies and, hence, sine waves are synthesized (i.e., harmonics are synthesized). When the ratio of synthesis is changed by altering the levels of the four part sounds, i.e., by changing the loudness data LN, then the shape of the musical waveform of the synthesized tone, as well as the timbre changes.

The above-mentioned four part sounds usually comprise the fundamental harmonic, a first harmonic, a second harmonic and a third harmonic. The fundamental harmonic has a fundamental frequency f1 corresponding to a preset pitch. The first harmonic, second harmonic and third harmonic have frequencies that are a multiple of f1, such as 2 times, 3 times, 4 times, 5 times, 6 times, 7 times 8 times, . . . , 16 times, of the preset pitch. Correctly speaking, however, this multiple has a relation of $fn=f1\times n\times root\ (1+C\times n^2)/root\ (1+C)$ (C is a constant, n is a harmonic number, and root is a square root of values in a succeeding parenthesis) relative to the fundamental frequency f1, and are shifted to some extent as will be described later. The four part sounds are synthesized into a tone which is output. As described above, the frequencies of the harmonics are not establishing correct ratios of integers and, hence, maintain a non-consonant relationship.

The data of the channel memory areas are written at an on timing and/or an off timing, are rewritten or read out at every channel timing, and are processed (treated) by the tone generator 5. The assignment memory 60 may be provided in the program/data storage unit 4 or in the controller 2 instead of in the tone generator 5.

The method for assigning the tones to the channels formed by the time-dividing process (treatment), i.e., to a plurality of tone-generating systems for generating a plurality of tones (part sounds) in parallel, or a truncating method, may be any one of those disclosed in, for example, Japanese Patent Publications Nos. 42298/1989, 305818/1989, 312175/1989, 208917/1990, 409577/1990 and 409578/1990.

5. Frequency Number Accumulator 42

FIG. 5 illustrates a first embodiment the frequency number accumulator 42. The frequency number data FN (key number data KN) and the tone number data TN read out in a time-dividing manner from the assignment memory 60 are converted by a non-consonance constant table 85 into non-consonance constants C through a latch 80. The non-consonance constant C represents a constant "C" in the relation $fn=f1\times n\times root\ (1+C\times n^2)/root\ (1+C)$ for finding a non-consonant frequency. Here, f1 denotes the fundamental frequency or the frequency number data FN, C denotes a constant, n denotes a harmonic number, and root denotes a square root of values in the succeeding parenthesis.

The non-consonance constant C is multiplied by the non-consonance degree adjustment data HM in the multiplier 90, and is processed in a non-consonant frequency operation circuit 91. The non-consonant frequency operation circuit 91 is serially provided (served) with the harmonic number data n from the assignment memory 60, and executes the operation of $n\times root\ (1+C\times n^2)/root\ (1+C)$. A multiplier 92 multiplies the frequency number data FN (f1) of the fundamental frequency and executes the operation $fn=f1\times n\times root\ (1+C\times n^2)/root\ (1+C)$. Thus, the part sounds are processed, i.e., frequency number data fn of the harmonics are processed. The frequency number data fn of the part sounds are converted by a sampling conversion table 93 into address values corresponding to the sampling steps of the practical musical waveform data MW.

The musical factors such as frequency number data FN, tone number data TN, touch data TC, key number data KN (high order), tone time data TM, resonance degree data KD, part number data PN and number-of-simultaneous-soundings data SS from the latch 28 of each of the channels of the assignment memory 60, and the data for specifying the selection by the operator, are converted into bank data BK, initial frequency number data IF, repeat top data RT and repeat end data RE by a frequency repeat ROM 88 through a latch 89, depending upon the data TN, TC, KN, TM, SS, KD and PN.

At the time of an on event, the initial frequency number data IF is added to the frequency number data FN through an adder 82 via a selector 81, and is set to a frequency number register 84 through a selector 83. The frequency number register 84 stores frequency number data FN of a plurality of channels, and is successively shifted by the channel clock signals CHø. Therefore, the frequency number data FN are successively accumulated with the initial frequency number data IF as an initial value for every dividing time of the 16 channels.

The repeat end data RE is fed to a comparator 86. The comparator 86 has also been served with the accumulated frequency number data FNA from the adder 82, and sends a comparison detection signal to the selector 83 when the accumulated frequency number data FNA exceeds the repeat end data RE. Therefore, the accumulated frequency number data FNA returns from the repeat end data RE to the repeat top data RT, and is successively accumulated.

The accumulated frequency number data FNA of the part sounds are input to the tone waveform memory 43 where the part sounds are read out in a time-dividing manner, and are multiplied by the loudness data LN through the multiplier 47 so that their levels are controlled, and are synthesized into a tone through the accumulator 46. Thus, the synthesis of harmonics is accomplished.

The high frequency number data n of the channels read out from the assignment memory 60 are arranged in series by a selector 94 through a latch 89, and are sent to the non-consonant frequency operation circuit 91. The selector 94 is provided (served) with, as a selection signal, the lower two bits of the channel number data 4CHNo having an increment speed 4 times as great.

The non-consonance degree adjustment data HM input by the operator using the group of panel switches 13 are stored by the controller 2 in a latch 95, and are input to the multiplier 90. The non-consonance degree of the part sounds to be synthesized is changed depending upon the non-consonance degree adjustment data HM. As the value of the non-consonance degree adjustment data HM increases, the value of the non-consonance constant C increases, and the consonance degree of the part sounds to be synthesized decreases.

The non-consonance degree adjustment data HM may be converted from the musical factors such as frequency number data FN, tone number data TN, touch data TC, key number data KN, tone time data TM, loudness data LN, harmonic number data n, resonance degree data KD and part number data PN for each of the channels read out from the assignment memory 60, and from the number-of-simultaneous-soundings data SS from the latch 28.

The synthesis of part sounds (i.e., the synthesis of harmonics) is accomplished by assigning the tone to the time-dividing channels and by reading out the part sounds in a time-dividing manner. This, however, may be accomplished by a plurality of sine wave generation/operation circuits. The sine waves are generated by the sine wave generation/operation circuit at speeds corresponding to the frequency number data fn of the part sounds, and the sine waves of each of the frequencies are generated and output, controlled for their levels, and are added up and synthesized. The sine wave generation/operation may be executed in a time-dividing manner.

6. Frequency Number Accumulator 42

FIG. 6 illustrates a second embodiment of the frequency number accumulator 42. In the second embodiment, the non-consonance difference table 97 and the non-consonance difference operation circuit 98 are constituted as described below. The frequency number data FN (key number data KN) and the tone number data TN read out in a time-dividing (time-sharing) manner from the assignment memory 60 are converted into difference data A of frequency number of the second harmonic by the non-consonance difference table 97 through the latch 80. The difference data A represents a difference in the practical frequency of the harmonic number data n=2 (i.e., the first harmonic) relative to the frequency 2 times as high as the fundamental frequency.

The difference data A is multiplied by the non-consonance adjustment data HM through a multiplier 90, and are operated through a non-consonance difference operation circuit 98. The non-consonance difference operation circuit 98 further receives harmonic number data n in series from the assignment memory 60, and executes the operation $n+(A/6)\times n^3$, $n+(A/6)\times(n^3-n)$ or $n+(A/6)\times(n^3-n^2+n-1)$. Thus, the frequency ratio is found for each of the part sounds, i.e., for every n-th harmonic. The frequency ratio includes the difference for the non-consonance. At shifted frequency ratios, the difference of the n-th harmonic frequency becomes $(A/6)\times n^3$, $(A/6)\times(n^3-n)$ or $(A/6)\times(n^3-n^2+n-1)$ relative to the frequency n times as great as the fundamental frequency.

The shifted frequency ratio is multiplied by the frequency number data FN (f1) of the fundamental frequency through the multiplier 92. Thus, frequency number data fn of the part sounds (i.e. of the harmonies) are obtained. The frequency number data fn of the part sounds are converted by a sampling conversion table 93 into address values corresponding to sampling steps of the practical musical waveform data MW. The constitution and operation in other respects are the sane as those of the frequency number accumulator 42 of the first embodiment shown in FIG. 5.

Fractions shown in the row of the second harmonic in FIG. 9 are the concrete values of the difference data A. For example, the difference data A are "0.002994761" in the case of a non-consonance constant $C=1.00\times10^{-3}$ of piano, "0.000299948" in the case of a non-consonance constant $C=1.00\times10^{-4}$ of harpsichord or piano, and "0.000029999" in the case of a non-consonance constant $C=1.00\times10^{-5}$ of guitar.

The difference data A are multiplied by the non-consonance degree adjustment data HM, and are set by the operation of the operator. The difference data A may be determined by the musical factors such as touch data TC, tone time data TM, loudness data LN, harmonic number data n, resonance degree data KD and number-of-simultaneous-soundings data SS in addition to the timbre. In this case, values of the non-consonance difference table 97 are read out depending upon the touch data TC, tone time data TM, loudness data LN, harmonic number data n, resonance degree data KD or number-of-simultaneous-soundings data SS.

The above-mentioned operations $fn=f1\times n\times root\,(1+C\times n^2)/root\,(1+C)$, $fn=f1\times[n+(A/6)\times n3]$, $fn=f1\times[n+(A/6)\times(n^3-n)]$ and $fn=f1\times[n+(A/6)\times(n^3-n^2+n-1)]$, may be executed by the controller 2 (CPU) based on the program processing.

7. Non-consonance Constant Table 85

FIG. 7 illustrates a non-consonance constant table 85 in the frequency accumulator 42. The non-consonance constant table 85 is served with the tone number data TN and the frequency number data FN, thereby to find a non-consonance constant "C". The non-consonance constant "C" is used in the relation $fn=f1\times n\times root\,(1+C\times n^2)/root\,(1+C)$ for finding a non-consonant frequency. Here, f1 is a fundamental frequency (frequency number data FN), C is a constant (non-consonance constant), n is a harmonic number, and root is a square root of values in the succeeding parenthesis.

The value of the non-consonance constant C is from $10^{-5}$ to $10^{-1}$ in the case of piano, from $10^{-5}$ to $10^{-3}$ in the case of harpsichord, from $10^{-5}$ to $10^{-4}$ in the case of guitar, and is from $10^{-5}$ to $10^{-1}$ as a whole. The value of the non-consonance constant C varies depending upon the pitch, i.e., depending upon the key number data KN. Further, the value of the non-consonance constant C varies depending upon the tone of a musical instrument, i.e., depending upon the timbre or tone number data TN.

The non-consonance constants C in FIG. 7 are found from the non-consonant harmonic frequencies, when various sounds formed by synthesizing non-consonant harmonics are comfortably heard by human ears. FIG. 9 illustrates the practically found frequency ratios. From these frequency ratios are derived the above-mentioned rule $fn=f1\times n\times root\,(1+C\times n^2)/root\,(1+C)$. In this case, the non-consonance constants C are derived, too.

Figure 8:
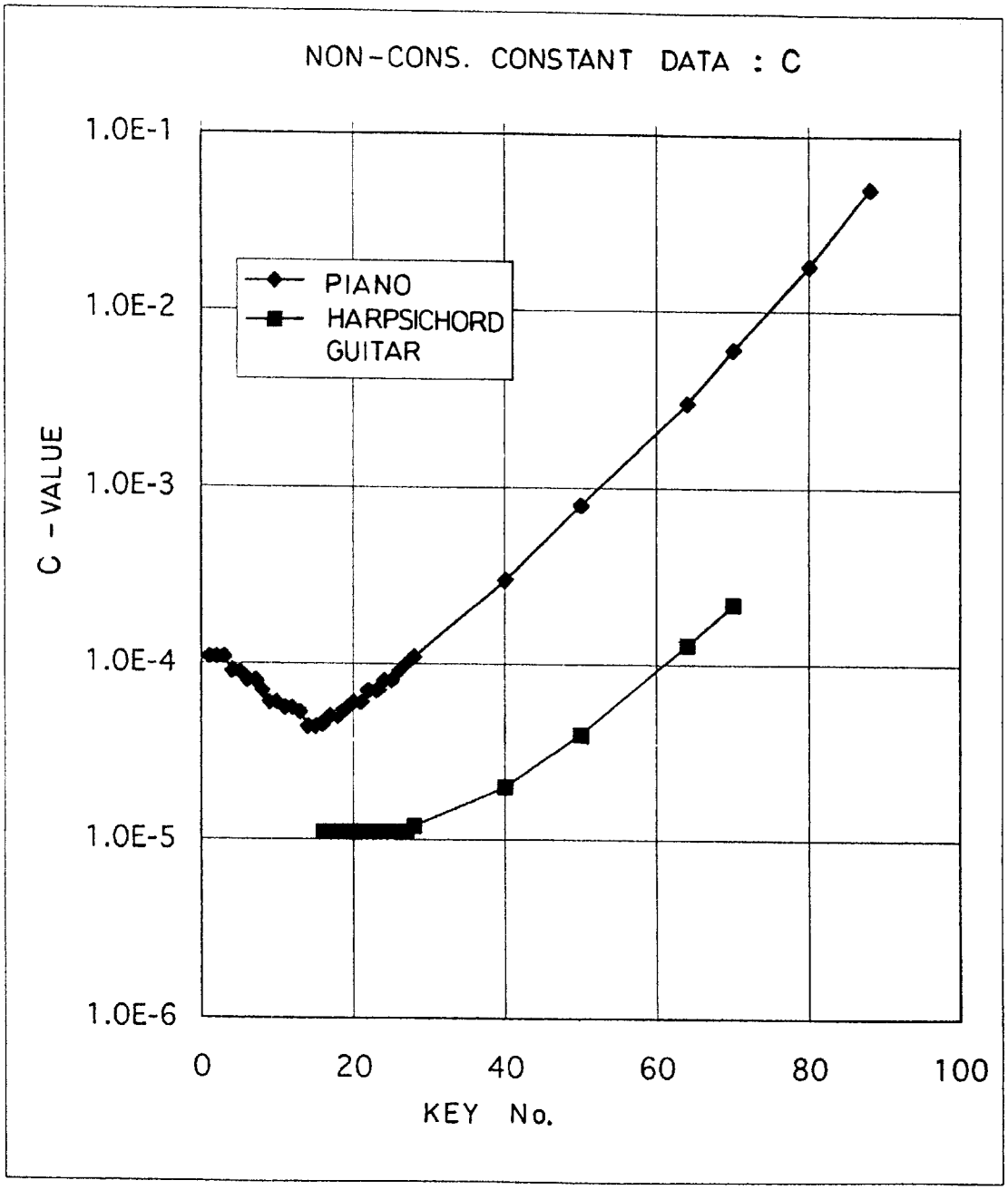
FIG. 8 is a diagram showing characteristics of non-consonance constants C relative to the pitch (key number data KN)

The non-consonance constants C of FIG. 7 are shown in a graph of FIG. 8. Ideal non-consonance constants C obtained through experiment vary depending on the pitch, i.e., depending on the key number data KN (frequency number data FN).

The non-consonance constants C may be determined by the musical factors such as touch data TC, tone time data TM, loudness data LN, harmonic number data n, resonance degree data KD and number-of-simultaneous-soundings data SS, in addition to timbre. In this case, the values of touch data TC, tone time data TM, loudness data LN, harmonic number data n, resonance degree data KD or number-of-simultaneous-soundings data SS are set instead of the kind (tone number data TN) of the musical instrument in a vertical column of FIG. 7.

8. Concrete Examples of Non-consonant Frequencies

FIG. 9 shows concrete numerical values of $fn=f1\times n\times root\,(1+C\times n^2)/root\,(1+C)$ operated by the non-consonant frequency operation circuit 91 and the multiplier 92. When the non-consonance constant is $C=1.0\times10^{-4}$, the ratios (frequency ratios) of the non-consonant frequencies fn to the fundamental frequency f1 are 2. 000299948, 3. 001199640, 4. 002998576, 5. 005995805, 6. 010489780, 7. 016778212, 8. 025157923, 9. 035924701, 10. 049373165, 11. 065796619, 12. 085486920, 13. 108734344, 14. 135827455, 15. 167052978, 16. 202695679, . . . , 33. 596796358, . . . , 75. 981210082, . . . , 207. 901955926 for harmonic number data n=2, 3, 4, 5, 6, 7, 8, 9, 10, 11, 12, 13, 14, 15, 16, 32, 64 and 128. Other frequency ratios are also shown in FIG. 9.

These frequency ratios were obtained from the most comfortable non-consonant harmonic frequencies based on actual experiment and measurement. From the measured values were derived the above-mentioned non-consonance frequency operation formula $fn=f1\times n\times root\ (1+C\times n^2)/root\ (1+C)$ and the non-consonance constants C.

Among the numerical values of these ratios, there are shown the ratios of non-consonant values of smaller than a decimal point and the differences from the ratios of integers. When the harmonics are synthesized at such non-consonant ratios, synthesized sounds are formed that are comfortable to human ears.

The following formula could be derived from the measured values. That is, when the frequency of the second harmonic relative to the fundamental frequency is shifted by a value A relative to the frequency 2 times as high as the fundamental frequency, the frequency of an n-th harmonic is successively shifted relative to the frequency n times as high as the fundamental frequency, and the shift becomes nearly $(A/6)\times(n^3-n^2+n-1)$. That is, the formula is expressed as $fn=f1\times[n+(A/6)\times(n^3-n^2+n-1)]$.

According to this formula, too, the above-mentioned non-consonant harmonic frequencies can be derived. Here, however, there is a slight difference from the result of operation by the non-consonant frequency operation formula $fn=f1\times n\times root\ (1+C\times n^2)/root\ (1+C)$, which, however, is almost negligible.

The following formula could be derived from the measured values. That is, when the frequency of the second harmonic relative to the fundamental frequency is shifted by a value A relative to the frequency 2 times as high as the fundamental frequency, the frequency of an n-th harmonic is successively shifted relative to the frequency n times as high as the fundamental frequency, and the shift becomes nearly $(A/6)\times n^3$. That is, the formula is expressed as $fn=f1\times[n+(A/6)\times n^3]$.

According to this formula, too, the above-mentioned non-consonant harmonic frequencies can be derived. Here, however, there is a slight difference from the result of operation by the non-consonant frequency operation formula $fn=f1\times n\times root\ (1+C\times n^2)/root\ (1+C)$. However, some harmonic number data n can be adapted to this formula. In such a case, there is almost no difference.

Concrete examples are shown on the extreme right in FIG. 9. In the case of the difference data A =0.000029999, a value $(A/6)\times n^3$ is given for other harmonics, according to which the error between the measured value and $(A/6)\times n^3$ is 12.5% for the third harmonic. For the fourth and higher harmonics, however, the error decreases down to 6.6% or smaller. Therefore, a different formula or stored value is used for the third harmonics only, and the formula $(A/6)\times n^3$ is used for the fourth and higher harmonics.

Thus, there is generated a synthesized sound of harmonics that can be comfortably heard by human ears. The harmonic of a harmonic number n=1 represents the fundamental harmonic, and is excluded from the harmonics in a narrow sense. Hence, the first harmonic becomes a second harmonic sound having a harmonic number n=2.

9. Overall Processing

Figure 10:
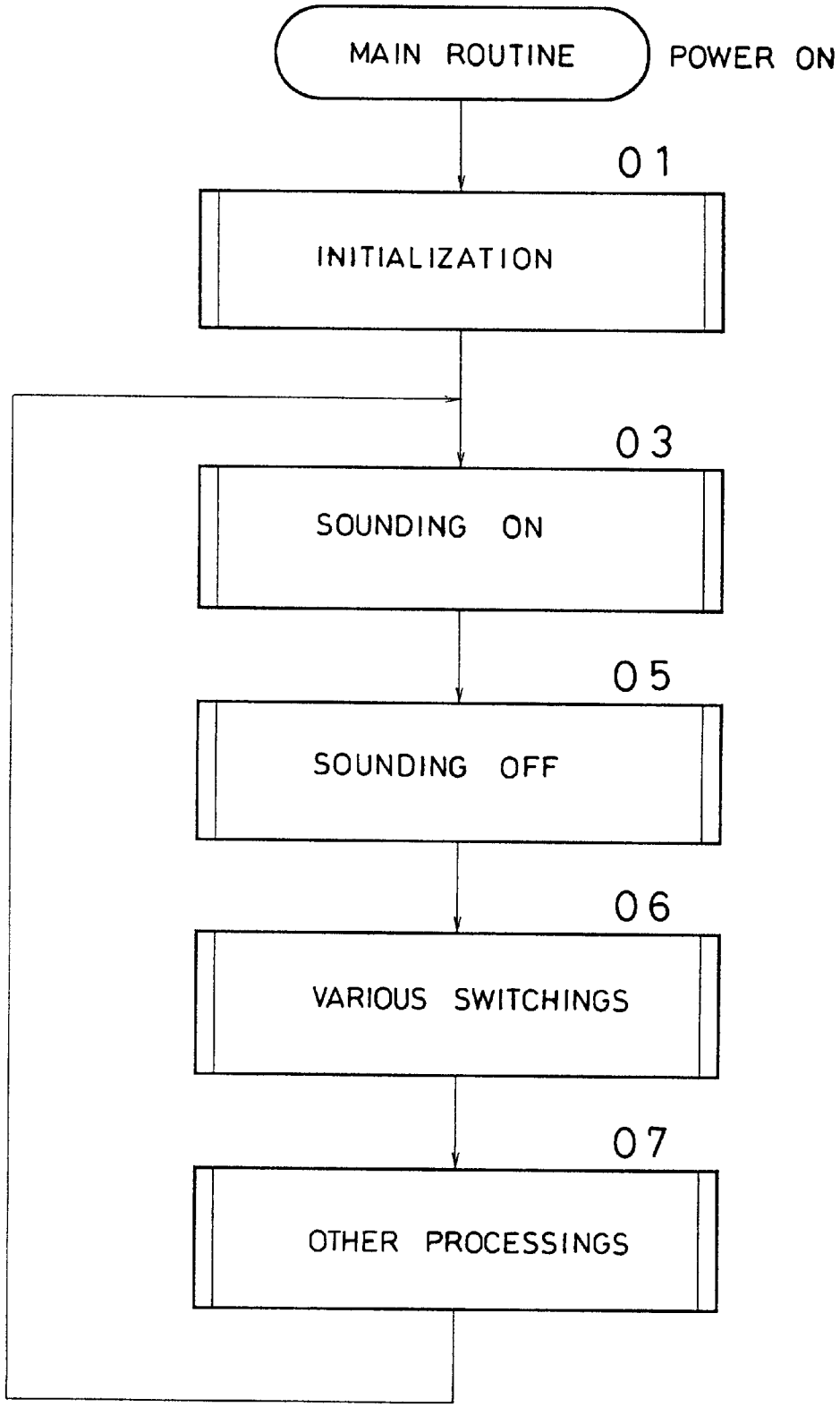
FIG. 10 is a flow chart illustrating the whole processing.

FIG. 10 is a flow chart of the overall processing executed by the controller (CPU) 2. The overall processing is started by the turn-on of the power source of the tone-generating apparatus, and is repetitively executed until the power source is turned off. First, a variety of initialization processings are executed for the program/data storage unit 3 (step 01), and a sounding start processing is executed based on the manual play or the automatic play by the performance information-generating unit 1 (step 03).

In the sounding start processing, an empty channel is searched, and a tone related to an on event is assigned to the empty channel that is searched. The content of the tone is determined depending upon the performance information (tone-generating data) from the performance information-generating unit 1, musical factor data in the tone control data, and musical factor data that have been stored already in the program/data storage unit 3.

In this case, on/off data "1", frequency number data FN, envelope speed data ES, envelope time data EL, and envelope phase data EF "0" are written into the area of the assignment memory 60 of the empty channel that is searched.

The four loudness data LN and four harmonic number data n according to the tone number data TN are also found by using the part sound table 10 and are written into the area of the assignment memory 60 of the empty channel that is searched. Additionally, tone number data TN, touch data TC, part number data PN and tone time data TM "0" are written to assignment memory 60.

Then, a sounding end (decay) processing is executed based on the manual play or the automatic play in the keyboard 11 or the panel switches 13 (step 05). In the sounding end (decay) processing, a channel to which a tone of an off event (key-off event, sounding end event) is assigned is searched, and the tone is decayed to end the sounding. In this case, the envelope phase of a tone related to the key-off event is released, and the envelope level gradually approaches "0".

Besides, upon operating a variety of switches of the panel switches 13, the musical factor data corresponding to the switches are accessed and are stored in the program/data storage unit 3, whereby the musical factor data are changed (step 06). Thereafter, other processings are executed (step 07), and the processing is repeated from the step 02 up to the step 07.

The operation $fn=f1\times n\times root\ (1+C\times n^2)/root\ (1+C)$ may be executed in the sounding start processing at step 03, i.e., in the processing for assigning the channels, and the frequency number data fn of the part sounds may be found by the program operation and may be written into the assignment memory 60. The four frequency number data fn are subjected to the parallel-serial conversion through the selector, and are sent to the sampling conversion table 93. The selector is the same as the above-mentioned selector 94.

Figure 11:
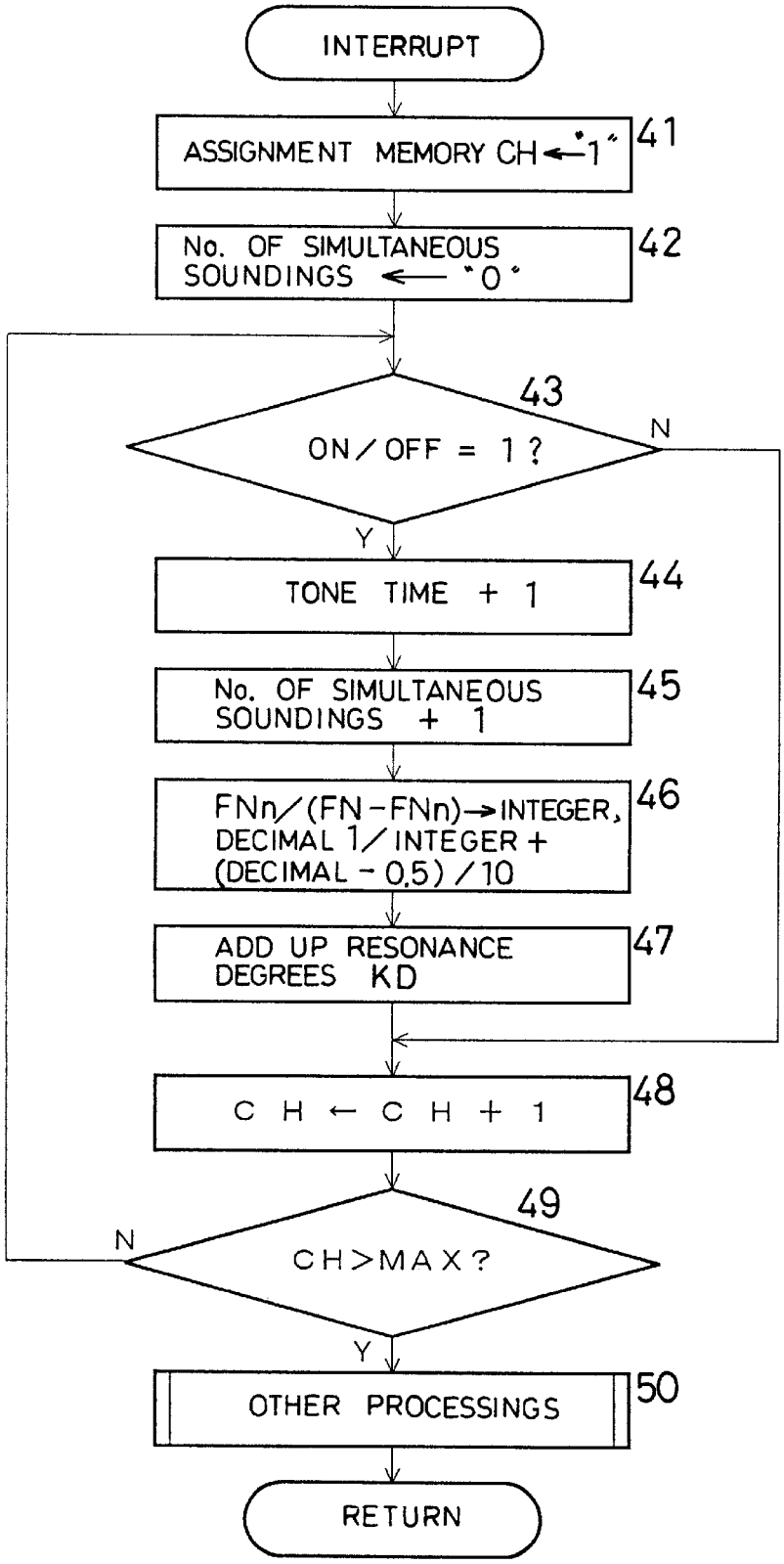
FIG. 11 is a flow chart illustrating an interrupt processing executed after every predetermined period.

10. Elapsed Time of Sounding, Number of Simultaneous Soundings and Resonance Degree FIG. 11 is a flow chart of an interrupt processing executed by the controller 2 after every constant (predetermined) period. Through this processing, the tone time data TM (elapsed time of sounding) is increased, the number-of-simultaneous-soundings data SS are counted, and the resonance degree data are calculated.

In this processing, the tone time data TM is increased by +1 (step 44) for the data of which the on/off data is "1" and where the tone is being sounded (step 43) for each of the channel areas (steps 41, 48, 49) of the assignment memory 60.

Similarly, after the number-of-simultaneous-soundings data SS in the latch 28 is once cleared (step 42), the data where the on/off data is "1" and where the tone is being sounded are counted (step 43). Additionally, the number-of-simultaneous-soundings data SS is successively increased by +1 (step 45) for each of the channel areas (steps 41, 48, 49) of the assignment memory 60. The number-of-simultaneous-soundings data SS counted is then stored in the latch 28.

Next, a difference between the key number data KN (frequency number data FN) and the key number data KN (frequency number data FN) of another channel area that is being sound, is found for the data where the on/off data is "1" and where the tone is being sounded (step 43) for each of the channel areas (steps 41, 48, 49) of the assignment memory 60. The key number data KN (frequency number data FN) is divided by this difference to find an inverse number of an integer part of the divided value. Further, a difference between a decimal part of the divided value and "0.5" is found, and a value which is 1/10 or 1/100 of the difference is added to the above inverse number (step 46).

The operated values are further found among other key number data KN (frequency number data FN) that are being sounded, and are accumulated (step 47). The accumulated value serves as the resonance degree data KD for the tone of the channel. The resonance degree data KD is found for all data where the tones are being sounded (steps 41, 48, 49, 43).

Then, other periodic processings are executed (step 50). Thus, the elapsed time of sounding of the tone is counted and stored for all channels, and is utilized as the sounding time data. Further, the number of the tones being sounded of all channels are frequently counted and stored, and are utilized as the number-of-simultaneous soundings data. Besides, the resonance degrees of the tones being sounded of all channels are frequently calculated and stored, and are utilized as the resonance degree data KD.

The present invention is in no way limited to the above-mentioned embodiments only but can be modified in a variety of ways without departing from the gist of the present invention. For example, the musical waveform data MW are those in which a given waveform is periodically repeated. However, the musical waveform data MW may have a waveform of an attack portion that changes in a complex manner, may have a PCM waveform of from the attack to the release, which does not occur periodically, or may be noise that does not almost change periodically. The sound signals may not have periodic nature.

The difference data A represents a difference in the frequency 2 times as high as the fundamental frequency as compared to the frequency of the second harmonic. But the difference data A may represent a difference between the frequency N times (N=3, - - - , 8, - - - ) as high as the fundamental frequency as cpmpared to the frequency of the Nth harmonic (N=3, - - - , 8, - - - ). Thus calculation contents of the non-consonant frequency operation formula $(A/6)\times n^3$, $(A/6)\times(n^3-n)$, $(A/6)\times(n^3-n^2+N-1)$ of the difference data is changed.

What is claimed is:

1. A non-consonance generating devices, comprising:

means for generating a signal for the fundamental frequency, f1, of a generated musical tone;

means for generating at least one harmonic signal of frequencies having a relationship $fn=f1*n*\sqrt{1+C*n^2}/\sqrt{1+C}$, where C is a constant and n is a harmonic number relative to f1; and means for synthesizing f1 and the at least one harmonic signal, and for outputting the synthesized signals as a modified musical tone.

2. The device of claim 1, wherein the constant C is determined from musical factor such as timbre, touch, tone pitch, elapsed time of sounding, number of simultaneous sounding and resonance degree of the musical tone determined based on a kind of musical instrument, or from selection by an operator.

3. The device of claim 1, wherein the value of the constant C is in a range of about $10^{-5}$ to $10^{-1}$ for a piano, in a range of about $10^{-5}$ to $10^{-3}$ for a harpsichord, in a range of about $10^{-5}$ to $10^{-4}$ for a guitar, and is generally in a range of about $10^{-5}$ to $10^{-1}$ .

4. The device of claim 1, wherein f1 is determined based on tone pitch of the musical tone, and, wherein amplitude of the signal of f1 or of the harmonic signal is determined by a musical factor.

5. A method for generating non-consonance, comprising:

generating a signal for the fundamental frequency, f1, of a generated musical tone;

generating at least one harmonic signal of frequencies having a relationship $fn=f1*n*\sqrt{1+C*n^2}/\sqrt{1+C}$, where C is a constant and n is a harmonic number relative to f1;

synthesizing f1 and the at least one harmonic signal; and outputting the synthesizing signals as a modified musical tone.

6. The method of claim 5, wherein the constant C is decided by musical factor such as timbre, touch, tone pitch, elapsed time of sounding, number of simultaneous sounding or resonance degree of the musical tone or a kind of musical instrument, or from selection by an operator.

7. The method of claim 5, wherein the value of the constant C is in a range of about $10^{-5}$ to $10^{-1}$ for a piano, in a range of about $10^{-5}$ to $10^{-3}$ for a harpsichord, in a range of about $10^{-5}$ to $10^{-4}$ for a guitar, and is generally in a range of about $10^{-5}$ to $10^{-1}$.

8. The method of claim 5, wherein f1 is determined based on tone pitch of the musical tone, and, wherein amplitude of the signal of f1 or of the harmonic signal is determined by a musical factor.

9. A non-consonance generating device, comprising:

means for generating a signal for the fundamental frequency, f1, of a generated musical tone;

means for generating harmonic signals, wherein frequency of an n-th harmonic is successively shifted based on A, the difference in frequency between the n-th harmonic and a frequency equal to n×f1, and wherein the shift is varied substantially in proportion to $A\times n^3$ when the frequency of a second harmonic, n=2, is shifted by A; and means for synthesizing the signal of f1 and the harmonic signals, and for outputting the synthesized signals as a modified musical tone.

10. The device of claim 9, wherein f1 is determined based on tone pitch of the musical tone, and, wherein amplitude of the signal of f1 or of the harmonic signal is determined by a musical factor.

11. A method of generating non-consonance; comprising:

generating a signal for the fundamental frequency, f1, of a generated musical tone;

generating at least one harmonic signal, wherein the frequency of an n-th harmonic is successively shifted based on A, the difference in frequency between the n-th harmonic and a frequency equal to $n \times f1$, and wherein the shift is varied substantially in proportion to $A \times n^3$ when the frequency of a second harmonic, n=2, is shifted by A;

synthesizing f1 and the at least one harmonic signal; and outputting the synthesized signals as a modified musical tone.

12. The method of claim 11, wherein f1 is determined based on tone pitch of the musical tone, and, wherein amplitude of the signal of f1 or of the harmonic signal is determined by a musical factor.

13. A non-consonance generating device, comprising:

means for generating a signal for the fundamental frequency, f1, of a generated musical tone;

means for generating harmonic signals, wherein the frequency of an n-th harmonic is successively shifted; based on A, the difference in frequency between the n-th harmonic and a frequency equal to $n \times f1$, and wherein the shift is varied substantially in proportion to $A/6*(n^3-n)$ or $A/6*(n^3-n^2+n-1)$ when the frequency of a second harmonic, n=2, is shifted by A; and means for synthesizing the signal of the fundamental frequency and the at least one harmonic signal and for outputting the synthesized signals as the musical tone.

14. The device of claim 13, wherein f1 is determined based on tone pitch of the musical tone, and, wherein amplitude of the signal of f1 or of the harmonic signal is determined by a musical factor.

15. A method of generating non-consonance; comprising:

generating a signal for the fundamental frequency, f1, of a generated musical tone;

generating at least one harmonic signal, wherein the frequency of an n-th harmonic is successively shifted based on A, the difference in frequency between the n-th harmonic and a frequency equal to $n \times f1$, and wherein the shift is varied substantially in proportion to $A/6*(n^3-n)$ or $A/6*(n^3-n^2+n-1)$ when the frequency of a second harmonic, n=2, is shifted by A;

synthesizing f1 and the at least one harmonic signal; and outputting the synthesized signals as a modified musical tone.

16. The method of claim 15, wherein f1 is determined based on tone pitch of the musical tone, and, wherein amplitude of the signal of f1 or of the harmonic signal is determined by a musical factor.

17. A computer program product comprising a computer-readable medium having computer program logic stored thereon for enabling a processor in a computer system to generate non-consonance, said computer program logic causing the processor to:

generate a signal for the fundamental frequency, f1, of a generated musical tone;

generate at least one harmonic signal of frequencies having the relationship $fn=f1*n*\sqrt{1+C*n^2}/\sqrt{1+C}$, where C is a constant and n is a harmonic number relative to f1;

add f1 and the at least one harmonic signals; and output the added signals as a modified musical tone.

18. The computer program product of claim 17, wherein the computer program logic thereon is embodied on the internet for transfer between processors of multiple computer systems.

19. A computer program product comprising a computer-readable medium having computer program logic stored thereon for enabling a processor in a computer system to generate non-consonance, said computer program logic causing the processor to:

generate a signal for the fundamental frequency, f1, of a generated musical tone;

generate at least one harmonic signal, wherein the frequency of an $n^{th}$ harmonic signal is successively shifted based on A, the difference in frequency between the $n^{th}$ harmonic and a frequency equal to $n*f1$, and wherein the shift is variable substantially in proportion to $A*n^3$ when the frequency of a second harmonic, n=2, is shifted by A;

add f1 and the at least one harmonic signals; and output the added signals as a modified musical tone.

20. The computer program product of claim 19, wherein the computer program logic thereon is embodied on the internet for transfer between processors of multiple computer systems.

21. A computer program product comprising a computer-readable medium having computer program logic stored thereon for enabling a processor in a computer system to generate non-consonance, said computer program logic causing the processor to:

generate a signal for the fundamental frequency, f1, of a generated musical tone;

generate at least one harmonic signal, wherein the frequency of an $n^{th}$ harmonic signal is successively shifted based on A, the difference in frequency between the $n^{th}$ harmonic and a frequency equal to $n*f1$, and wherein the shift is variable substantially in proportion to $A/6*(n^3-n)$ or $A/6*(n^3-n^2+n-1)$ when the frequency of a second harmonic, n=2, is shifted by A;

add f1 and the at least one harmonic signals; and output the added signals as a modified musical tone.

22. The computer program product of claim 21, wherein the computer program logic thereon is embodied on the internet for transfer between processors of multiple computer systems.

* * * * *